United States Patent [19]

Van Doorn et al.

[11] Patent Number: 4,569,264

[45] Date of Patent: Feb. 11, 1986

[54] APPARATUS FOR CUTTING ELONGATED MATERIAL INTO SHORTER LENGTHS

[75] Inventors: Donald W. Van Doorn; James B. Hawkins; William A. Harmon; Terry L. McKenzie; William D. Beeland, all of Columbus, Ga.

[73] Assignee: Lummus Industries, Inc., Columbus, Ga.

[21] Appl. No.: 676,521

[22] Filed: Nov. 29, 1984

[51] Int. Cl.[4] ..... D01G 1/04

[52] U.S. Cl. ..... 83/100; 83/346; 83/402; 83/913

[58] Field of Search ..... 83/913, 346, 402, 100

[56] References Cited

U.S. PATENT DOCUMENTS

| | | | |
|---|---|---|---|
| 3,485,120 | 12/1969 | Keith | 83/913 X |
| 3,831,481 | 8/1974 | Van Doorn et al. | 83/913 X |
| 4,014,231 | 3/1977 | Hutzezon | 83/100 |
| 4,169,398 | 10/1979 | Wadsworth et al. | 83/346 |
| 4,300,422 | 11/1981 | Potter | 83/913 X |
| 4,369,681 | 1/1983 | Van Doorn et al. | 83/100 |
| 4,391,169 | 7/1983 | Laird et al. | 83/346 X |
| 4,515,054 | 5/1985 | McLaughlin, Jr. | 83/346 X |

*Primary Examiner*—Frank T. Yost

*Attorney, Agent, or Firm*—Woodford R. Thompson, Jr.

[57] ABSTRACT

An outside-in tow cutter having a horizontal axis of rotation for its cutter reel assembly which includes an inner plate and an outer ring carrying radially disposed cutter blades, the outer ring having an inner diameter slightly smaller than the diameter of the circle formed by the cutting edges of the blades. The outer ring also carries an annular lip which cooperates with a snug fitting discharge hooper so that a subatmospheric pressure may be induced within said reel and said discharge housing to facilitate the removal of cut tow therefrom and to provide for pneumatically drawing the uncut tow onto the cutter reel assembly via an inlet housing.

26 Claims, 5 Drawing Figures

10
11
12
14
16
17
18
20
22
24
25
26
27
28
30
31
32
34
35
36
39
60

10
11
12
14
16
18
20
22
24
27
28
29
30
31
32
34
35
36
64
70
2

APPARATUS FOR CUTTING ELONGATED MATERIAL INTO SHORTER LENGTHS

BACKGROUND OF THE INVENTION

This invention relates to a device for cutting fibrous material into shorter lengths for use in the textile industry and more particularly the invention relates to an outside-in tow cutter.

Modern devices for cutting fibrous material, tow, in the textile industry are, in general, improvements on the basic type tow cutter as patented by Garland Keith in U.S. Pat. No. 3,485,120 in 1069. Such apparatus are designed so that a number of layers of uncut tow are wrapped spirally on the radially outturned cutting edges of a plurality of blades whose edges are uniformly spaced from the center of rotation of the reel upon which the blades are mounted. Such reels are constructed of a disc with a center mounted hub for powered rotation, and a ring that supports one end of the cutting blades. The disc and ring thus form flanges between which the tow wound on the reel is held. A cylindrical pressure roller fits snugly between the flanges and its periphery is held at a uniform distance from the cutting edges of the blades, thereby forcing the tow radially inward to the cutting blades. Such machines were initially used for process speeds up to as high as 500 meters per minute; however, with the development of higher speed spin-draw lines in the man-made fiber industry, speeds have increased substantially above 500 meters per minute and centrifugal force has become a major factor in the function of the Garland Keith concept. With higher rotational speeds the mass of uncut tow plus the mass of cut staple inside the cutting edges of the blades becomes a substantial factor.

It is therefore an object of this invention to provide a tow cutter capable of operating at speeds in excess of 2,000 meters per minute.

It is another object of the instant invention to reduce the mass of cut fibrous material carried by the reel during operation thereby reducing the centrifugal forces and consequent stress placed on the uncut tow.

Yet another object of the invention is to provide a more gradual cutting action between the pressure roller and the cutting blades thereby reducing the impact forces of high speed operation.

Still another object of the invention is to provide a tow cutter which is self-threading at initial start-up and can be threaded with a second tow while a first tow is running on the reel.

SUMMARY OF THE INVENTION

These objects are advantageously accomplished in the present invention which comprises an outside-in tow cutter wherein the axis of rotation is preferentially horizontal. The reel of the present invention carries a mounting hub which provides drive power to an inner disc which in turn cooperates with radially disposed cutter blades and associated blade support posts. An outer ring of the instant invention has an internal diameter slightly smaller than the diameter of the circle defined by the path of movement of the cutting edges of the blades, whereby the blade support posts are operatively connected in a unique manner to the interior rim of the outer ring and to the inner disc rather than being seated in the outer ring as is common practice. The outer ring also carries a lip or ring flange which projects outwardly from the reel and extends parallel to the axis of rotation thereof. The ring flange is conically inclined so that it flares outwardly from the junction of the outer ring with the blade support posts. The ring flange cooperates with a hinged discharge housing or hopper to form a substantially air-tight seal therebetween. Sub-atmospheric pressure is induced within the reel and hopper to generate airflow from the reel housing through a discharge housing thereby carrying cut staple away from the reel.

Disposed in close proximity to said reel is an input housing which is cooperatively positioned to advantageously introduce tow into the reel whereupon the air currents generated by the sub-atmospheric pressure carry the tow onto the reel until successive layers are accumulated thereon. In order to minimize impact forces heretofore encountered, the diameter of the pressure roller has been increased to exceed one-half the diameter of the cutter reel.

BRIEF DESCRIPTION OF DRAWINGS

Apparatus embodying features of our invention is illustrated in the accompanying drawings, forming a part of this application, in which.

DESCRIPTION OF THE PREFERRED EMBODIMENT

Figure 1B:
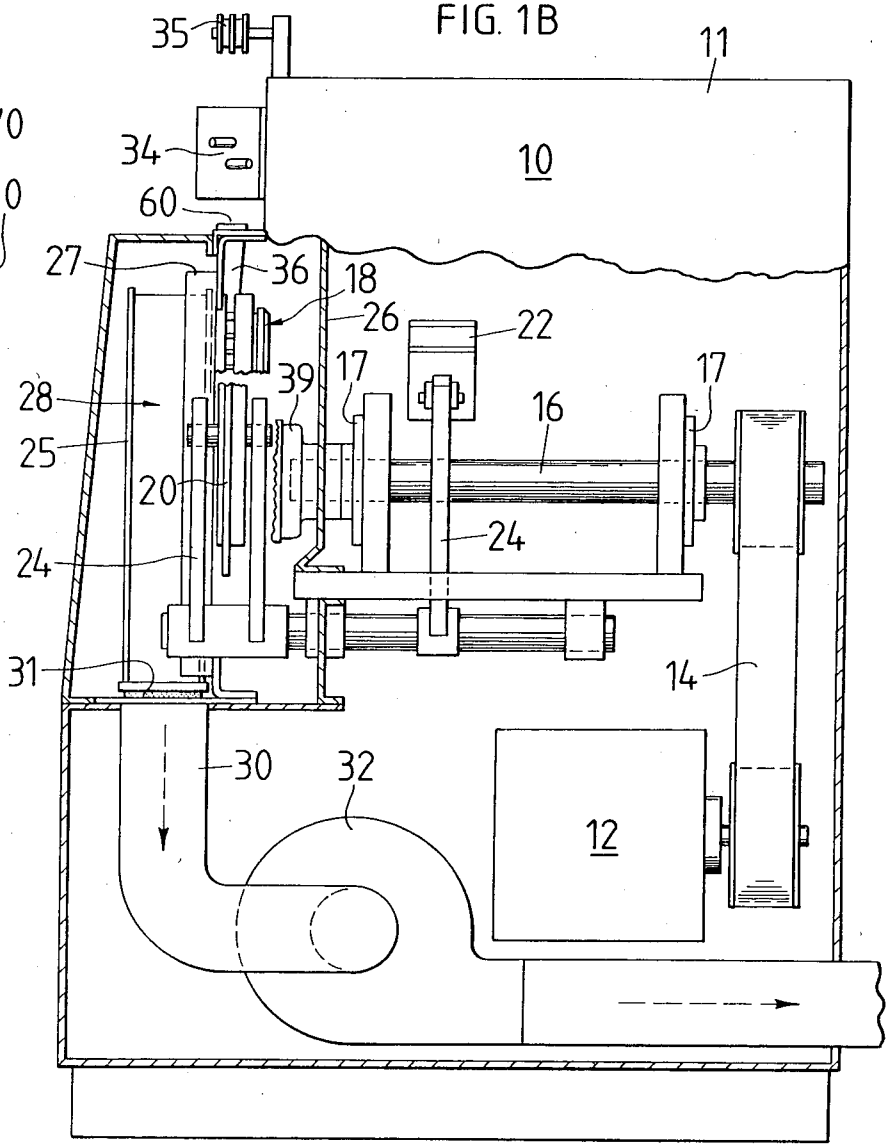
FIG. 1B is a side elevational view of the tow cutter, with parts being broken away and in section.
Figure 1A:
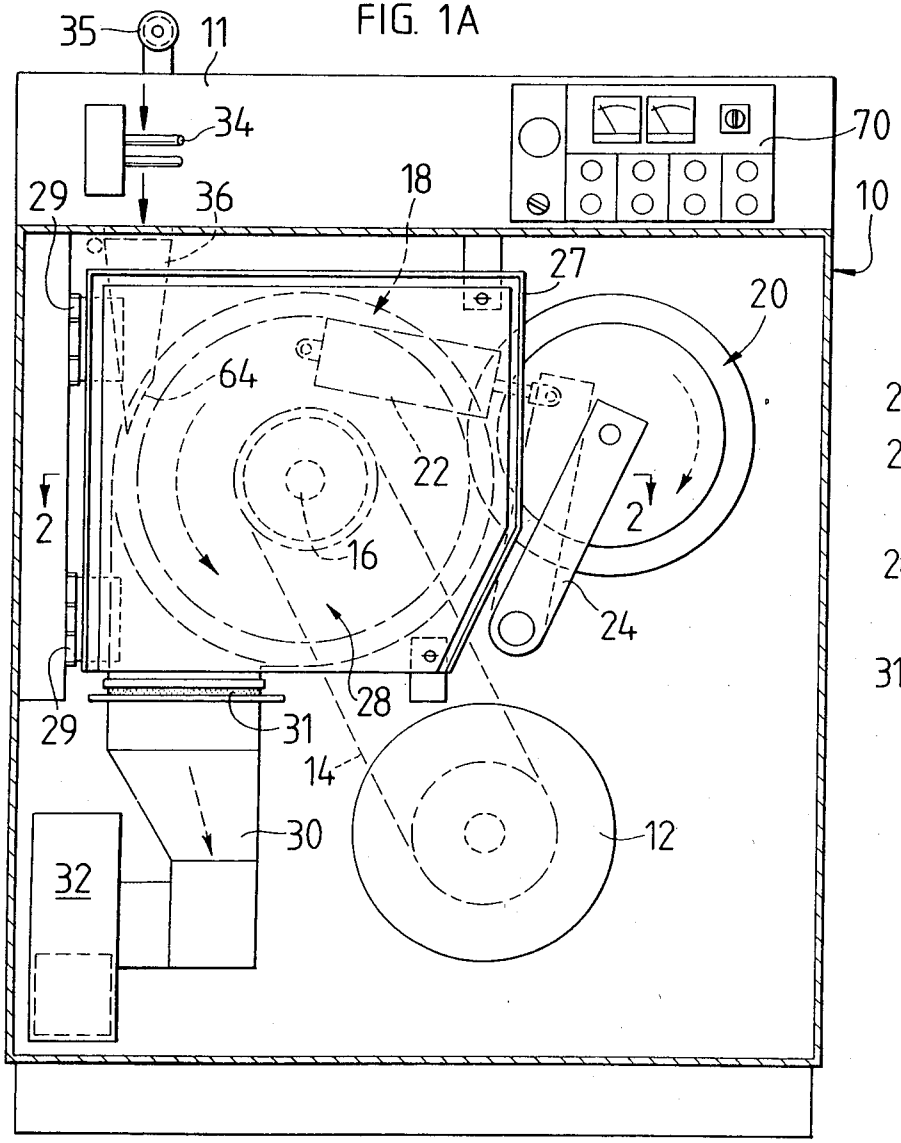
FIG. 1A is a front elevational view of the tow cutter showing its housing broken away and in section.

Referring now to the drawings for a better understanding of our invention, FIGS. 1A and 1B provide an overall view of the tow cutter assembly 10 from which it will be readily apparent that the tow cutter is horizontally oriented rather than vertically oriented, as has heretofore been the usual practice. In accordance with such conventional practice a drive motor 12 is utilized to drive a timing belt 14 which is operatively connected to a drive shaft 16 which in turn is connected to a cutter reel assembly indicated generally at 18. The drive shaft 16 is supported by drive shaft mounts 17 which are also conventional for horizontally mounted drive shafts. The cutter reel assembly 18 is shown more clearly in FIG. 2 and will be described in more detail hereinafter. Cooperatively positioned for normal interaction with the cutter reel assembly 18 is a pressure roller 20 which is held in cooperative position by roller mounting arms 24. The arms 24 may be adjusted in a conventional manner by a pressure roller adjustment assembly indicated generally at 22.

Figure 2:
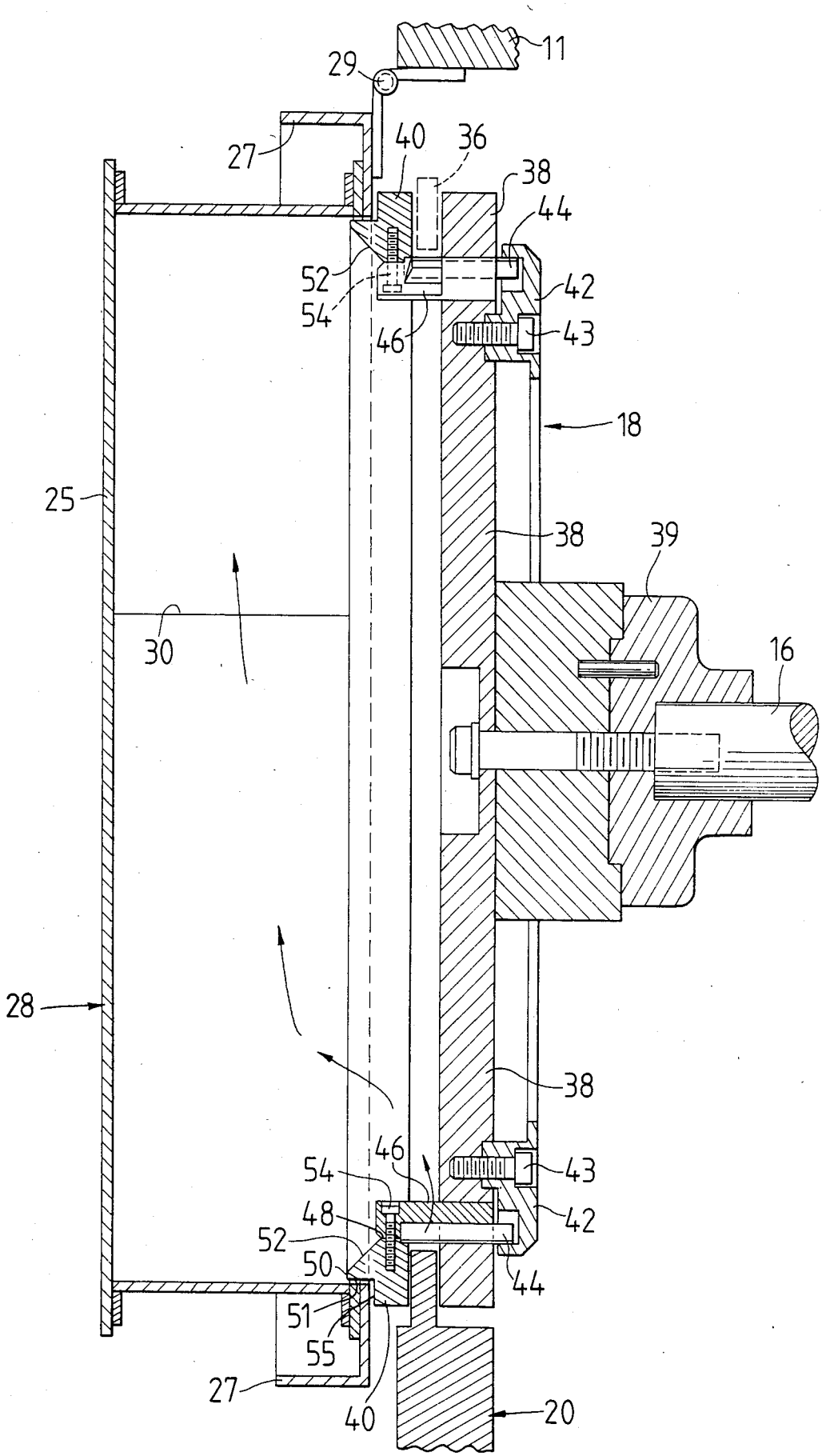
FIG. 2 is a sectional view of the reel assembly taken generally along the line 2—2 of FIG. 1A, with parts being omitted for the sake of clarity.

In order to overcome the centrifugal loading inherent in a cutter reel of a tow cutter it is necessary to reduce the mass of fibrous material being carried by the reel. One expedient is to reduce the distance between the components of the cutter reel assembly 18. With reference to FIG. 2 the cutter reel assembly is comprised of an inner plate 38 which is operatively connected by a mounting flange 39 to a drive shaft 16. The inner plate 38 and an outer ring 40 have positioned therebetween a plurality of angularly spaced cutter blades 44. Each of the cutter blades 44 is held in place by an annular blade retainer 42 and a blade support post 46. The blade retainer 42 is attached to the inner plate 38 by blade retainer fasteners 43. The blade support posts 46 are secured tightly in holes in the inner plate 38 and are bolted or otherwise attached to the inner surface of the outer ring 40 by radial fasteners 54 or other attaching means.

To reduce the centrifugal loading on the cutter reel assembly, the space between inner plate 38 and the outer ring 40 is decreased, thereby decreasing the transit distance from the innermost edges of the cutter blades 44 to the outermost restricted diameter of ring 40. This narrowing of the spaces between inner plate 38 and the outer ring 40 is practical because the higher the speed of spinning and drawing, the smaller the tows may be to accomplish the desired production rate.

Figure 4:
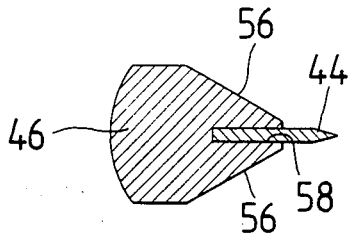
FIG. 4 is a sectional view through the cutter blade and its support post.

It is common in conventional tow cutters, utilizing the basic Garland Keith principle, for an accumulation of staple to build up in a somewhat triangular shape inwardly of the blades as the staple slides over the inner lip of the ring. It should be noted that the instant design has reduced the inner lip of the outer ring 40 such that its inner diameter is only slightly less than the diameter of the circle defined by the path of movement of the cutting edges of cutting blades 44. A difference of less than 15 mm is deemed satisfactory. With this novel construction the blade support posts 46 fit against the inside surface 48 of outer ring 40. This requires the blade support posts 46 to be machined from larger sections of either round or rectangular material. The posts themselves are machined to fit accurately against the cylindrical inner surface 48 of outer ring 40. Radial fasteners 54 for the blade support posts may hold the outer ring 40 to the machined surface of blade support posts 46. With reference to FIGS. 2 and 4, it can be seen that the portion of blade support posts 46 intermediate inner plate 38 and outer ring 40 have been beveled or shaped in a triangular manner to facilitate the smooth transfer of cut staple from the blade edges to the inside of reel assembly 18. Blade support posts 46 have a longitudinal blade slot 58 within which cutter blade 44 is seated. The beveled surfaces 56 of blade support posts 46 are inclined whereby they flare outwardly away from the portion of cutting blade 44 intermediate inner disc 38 and outer ring 40.

Referring to FIG. 2 there is a sloping conical surface 52 which flares outwardly from the junction of the outer ring 40 and blade support post 46. The conical surface 52 terminates in the outer lip 50 which projects from outer ring 40 in a direction parallel to the axis of rotation of the reel assembly 18. The outer lip 50 has been extended beyond the distance required for structural support for outer ring 40, as shown. Outer ring 40 thus provides a conventional radial flange 55 for retaining uncut tow within the reel assembly 18 and the axially extending lip 50, said flange and lip joining on the outer surface of ring 40 to form a shoulder 51. A staple receiving hopper 28 is provided which fits in close juxtaposition to shoulder 51 such that lip 50 extends within hopper 28. The extension of lip 50 and the conical surface 52 within the hopper 28 is desirable for two reasons. First, the conical surface 52 must support the fibers as they flow out of the reel assembly 18 and direct the cut fibers into hopper 28. Therefore the conical surface 52 must extend inside hopper 28 so that the cut fibers are guided into hopper 28 without the possibility of being slung out through the space between outer ring 40 and hopper 28. Secondly, the conical surface 52 must support the fibers that may be cut at one end only, i.e. by only one blade. Such fibers would be lying against the conical surface 52 under the influence of centrifugal force and if such fibers extended into the airstream within hopper 28 whereby there exists very high turbulence they would entangle cut staple passing thereby in close proximity and would also pull their uncut ends circumferencially across the adjacent blade resulting in unequal staple lengths. Therefore the distance from the cutting edge of the cutter blade 44 to the outer portion of the conical surface 52 is designed to exceed the distance between the cutter blades spaced about the reel assembly 18.

Hopper 28 fits snugly about the shoulder 51 formed by lip 50. This snug fit, in effect a labyrinth seal, not only causes proper discharge of the cut fiber into discharge hopper 28 but also allows the development of subatmospheric pressure inside the reel assembly 18. Discharge hopper 28 has a lower discharge outlet to a lower discharge section 30 which in turn communicates with a fan or air pump 32 which induces a subatmospheric pressure that reaches into the blade area of the reel assembly 18. It will be noted that discharge hopper 28 has a cover section 25 and a mounting plate 27 and is mounted on hinges 29 which are aligned in a plane which extends through the overlapping fit between outer ring 40 and discharge hopper 28. This hinged mounting allows discharge hopper 28 to be swung away from the reel assembly 18, thereby allowing inspection of reel assembly 18 or removal and reinstallation of reel assembly 18 in a rapid and efficient manner. Inasmuch as hopper 28 is hingedly mounted and yet is connected to the lower discharge section 30, in order to maintain the subatmospheric pressure within the reel assembly 18 a seal 31 is provided between hopper 28 and the lower discharge section 30. The seal 31 is preferentially formed of a resilient flexible material to provide a substantially uniform and long-life seal which is attached to the lower extremity of the hopper 28 where hopper 28 is in close proximity to lower discharge section 30. Hopper 28 will provide the outer seal for the reel assembly 18, and an intermediate panel 26 positioned behind reel assembly 18 and pressure roller 20 separates these mechanisms from the power driving section of the tow cutter 10 and provides a substantially sealed area about the reel assembly 18.

The subatmospheric pressure induced inside the reel assembly 18 allows the tow cutter 19 to be self-threading at the high speed at which the tow is being fed into cutter 10. In the spin-draw processes producing the high speed tows, the spinning and drawing operations cannot be stopped without a costly restart process. Therefore, the cutter must be threaded up "on the fly". Conventionally this is accomplished with the use of aspirator guns that use the injector principle to collect the tow into the gun barrel and deposit it through a connecting pipe system into a waste collector while switching from one cutting machine to another or while a relatively short shutdown occurs during rethreading when only a single cutter is being used. By providing subatmospheric pressure within reel assembly 18 great enough to overcome the centrifugal fan action of the fast rotating cutter blades 44, air is introduced inwardly through the spaces between blades 44. The proven result of the subatmospheric pressure inwardly of the blades 44 is that a tow introduced into the space between the outer ring 40 and the inner plate 38 outside cutter blades 44 is indeed pulled toward blades 44 and wraps itself around the cutting edges of blades 44, thus the cutting operation automatically commences when the speed of the tow being fed into the cutter is coordinated with the speed of rotation of the cutter reel assembly 18. Secondly, the subatmospheric pressure within reel assembly 18 and hopper 28 does induce air currents through the labyrinth seals between the reel assembly 18 and hopper 28 after the cutter blades 44 have been covered by the wrapped tow. These air currents tend to lift the cut fiber off the conical surface 52 and cause the fibers to follow the airstream out of hopper 28 into lower discharge section 30.

Figure 3:
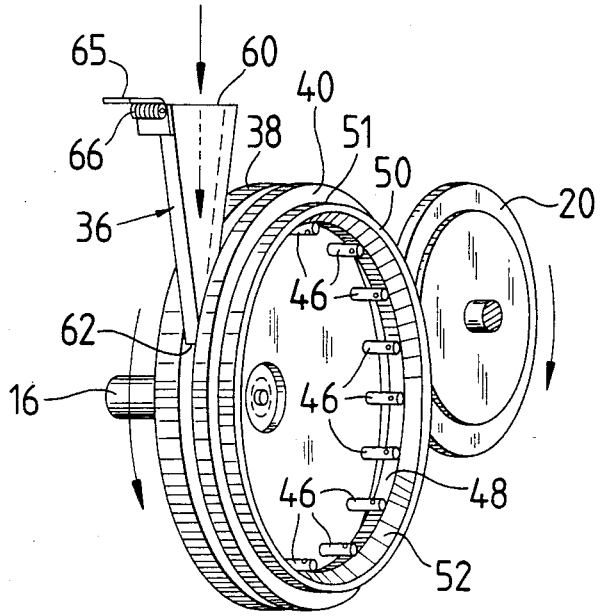
FIG. 3 is an isometric view depicting the tow inlet housing in conjunction with the reel assembly and pressure roller.

In order to take advantage of the self-threading feature of the instant tow cutter, a tubular tow inlet housing 36, shown in FIG. 3, may be provided which is open to the outside of the cabinet 11 of two cutter 19 to define an inlet 60. The discharge end 62 of the inlet housing 36 is located in close proximity to the reel assembly 18 such that tow directed therethrough is directed between the flanges of the reel assembly 18. This outlet 62 has an arcuate terminus 64 which fits in close relation to the flanges of reel assembly 18 so that on the initial thread-up when the reel assembly 18 has no tow wrapped around cutter blades 44, the subatmospheric pressure hereinabove described will create an airstream flowing through tow inlet housing 36, which will enable the tow to be threaded up at high speeds with the use of an aspirator gun. The aspirator gun must be placed in close proximity to inlet 60 so that the air currents through tow inlet housing 36 may take the tow away from the gun and into the housing. The discharge opening of arcuate terminus 64 must be smaller than the distance between the inner plate 38 and outer ring 40 in order for the tow to be properly fed onto reel assembly 18. It should be clear at this point that seal 31, the labyrinth seal between outer ring 40 and hopper 28, and the seal provided by intermediate panel 26 provides a housing which is sufficiently air-tight that the subatmospheric pressure within this assembly will force air to be taken in through tow inlet housing 36 rather than allowing air to flow freely through the reel between all blades. Tow inlet housing 36 is mounted on a hinge 65 and urged into close proximity at the arcuate terminus 64 thereof to reel assembly 18 by a spring 66 or other resilient means. This hinged construction allows tow inlet housing 36 to pivot away from reel assembly 18 when an occasional tow wrap-up, or "blow-up" as it is commonly called, on the reel occurs. When the tow wrap-up occurs hinge 65 allows tow inlet housing 36 to simply swing away thereby avoiding damage to the housing. Of course tow inlet housing 36 may also be manually pivoted away from reel assembly 18 for convenience in removing and reinstalling the cutter reel assembly 18.

It is sometimes necessary to thread up a second tow while a first tow is already running on reel assembly 18. Under such conditions, the first tow will have blocked off the air movement between blades 44 of the reel assembly 18 and therefore the subatmospheric pressure used to thread up the first tow is not available for threading up the second tow. However, hinged tow inlet housing 36 is designed and positioned relative to the tow inlet guides 34 and tow guide wheel 35 that a second tow may be brought in close proximity with inlet 60 to tow inlet housing 36 by means of an aspirator gun. The air pressure of the aspirator gun may then be reduced so that the second tow will be mechanically entrained by the first tow as it enters tow inlet housing 36. The converging surfaces of tow inlet housing 36 will force the second tow to be entrapped between the first tow and the tow wrapped around reel assembly 18. Once the leading end of the second tow is wrapped between the first tow being wound on the reel and the tow already on reel assembly 18 the second tow will be positively pulled onto reel assembly 18. To accomplish this, the discharge opening of the tow inlet housing should be slightly narrower than the distance between the flanges of the reel. Of course, the overall configuration of tow inlet housing 36 is such that inlet end 60 is larger than discharge end 62 with the body of tow inlet housing 36 tapering from inlet 60 to discharge end 62 at its arcuate terminus 64. In addition guides 34 and a guide wheel 35 are properly positioned to prevent the two tows hereinabove described from touching each other until the moment that the second tow is released by the aspirator gun into inlet 60.

With reference to FIG. 1A it can be seen that pressure roller 20 has a diameter which is greater than one-half the diameter of reel assembly 18. Previous pressure rollers employing the principles of the Garland Keith U.S. Pat. No. 3,485,120 have used pressure rollers smaller than one-half the diameter of the reel. At the very high speeds utilized by the instant cutter the cutting action takes place very quickly, and fiber fusing can result unless the impact forces can be reduced. The function of the larger diameter of pressure roller 20 is to provide a more gradual cutting action as the convergence between the periphery of pressure roller 20 and the locus of the cutting edges of the cutting blades 44 becomes more gradual as the pressure roller diameter increases.

In operation the device is controlled from a control panel 70 mounted onto cabinet 11 which encloses all of the hereinabove described mechanical linkages. Cutter reel assembly 18 is rotated due to the mechanical action of drive motor 12, timing belt 14 and drive shaft 16. To initiate operation, the cutter reel assembly 18 is brought up to the desired rotational speed as fan 32 induces a subatmospheric pressure inwardly of the blades 44 of reel assembly 18. This subatmospheric pressure inwardly of the blades 44 induces an airflow through tow inlet housing 36 which air flow is utilized to introduce the free end of a tow into the reel assembly proximal the arcuate terminus 64 of tow inlet housing 36. The subatmospheric pressure in conjunction with the rotating cutter blades entrain the tow so as to wrap the tow about the reel assembly 18 thereby drawing the tow over guide wheel 35, past tow guide 34, and through tow inlet housing 36. The tow is wrapped around reel assembly 18 to a sufficient depth as to engage pressure roller 20 which forces the wrapped tow inward, cutting the innermost tow at the locus of the periphery of pressure roller 20 and cutter blades 44. The cut tow or staple then flows inward of reel assembly 18 over the beveled blade support surfaces 56 to the conical surface 52 of axially extending lip 50 whereby said cut staple is discharged into discharge hopper 28. Air currents entering via the labyrinth seal between outer ring 40 and discharge hopper 28 lift the cut staple from the conical surface 52 and assist in directing such cut staple into the air pathway from ring 40 through discharge hopper 28 into lower discharge section 30 under the influence of the air currents set up therein by the action of fan 32. Discharge section 30 transports the cut staple to a suitable location for the next step in the processing of the fibers into a finished textile, said next step in the process being outside the scope of the present invention. To introduce a second tow to the cutter reel assembly 18 the second tow is discharged into inlet 60 of tow inlet housing 36 so as to be mechanically entrained by the first tow about cutter reel assembly 18 and is thereby positively drawn onto reel assembly 18.

The foregoing description has presented an embodiment of an improved tow cutter which reduces the centrifugal loading on both the tow cutter reel assembly and the uncut tow thereon by reducing the distance within the reel that the cut tow is required to transverse, and by reducing the accumulation of cut staple within the reel assembly through the use of advantageously beveled blade support posts and an outer ring having an inner diameter only slightly smaller than the diameter of the cutting edges of the cutting blades. The ring 40 also has a conical shaped outer lip which effectuates the transfer of cut staple from the reel assembly into a discharge hopper. Further, the hereinabove tow cutter provides an improvement in introducing tow into the tow cutter such that the tow cutter may be threaded up "on the fly" at initial start-up due to the advantageous utilization of subatmospheric pressure within the reel assembly or may be automatically threaded during operation by a second tow mechanically entrained to a first tow previously wrapped about reel assembly 18. The invention also improves the cutting action of previously known tow cutters by providing for a more gradual cutting action at high operating speeds thereby reducing fiber fusing which results from high impact forces between the pressure roller and the cutter blades.

While we have shown our invention in but one form, it will be obvious to those skilled in the art that it is not so limited, but is susceptible of various changes and modifications without departing from the spirit thereof.

What we claim is:

1. An apparatus for cutting fiber into short lengths comprising, in combination:

(a) a driven reel for carrying fibers having an inner plate and an outer ring and a plurality of angularly spaced blades for cutting said fiber disposed in a circular arrangement between said plate and ring with the cutting edges of said blades facing outward, said outer ring having an inner surface of a diameter slightly smaller than the diameter of the circle defined by the path of movement of said cutting edges of said blades;

(b) a plurality of blade support posts mounted along said inner surface of said ring such that each blade support post serves to support one of said blades;

(c) means for introducing uncut fiber onto said reel between said plate and ring;

(d) a pressure roller having a periphery cooperatively positioned between said plate and ring to urge said fiber introduced onto said reel toward said cutting blades;

(e) housing means mounted in abutting relation with said outer ring such that airflow therebetween is substantially reduced; and (f) means for sustaining a subatmospheric pressure within said housing means and said reel such that air is drawn into said housing via said means for introducing uncut fiber onto said reel.

2. Apparatus as defined in claim 1 wherein said outer ring has an axially projecting annular lip extending into said housing means to facilitate the flow of material thereinto.

3. Apparatus as defined in claim 2 wherein said axially projecting annular lip has a conical surface which flares outwardly from the inner surface of said outer ring.

4. Apparatus as defined in claim 3 wherein the distance from said cutter blade to the outer portion of said conical surface is greater than the space between adjacent cutter blades.

5. Apparatus as defined in claim 2 wherein said housing means comprises a cover having an opening therein of a diameter slightly greater than the maximum diameter of said annular lip for receiving said annular lip, such that said cover and said ring cooperate to form a labyrinth seal to reduce the passage of air therebetween, with said cover having a port for the discharge of cut fiber therefrom along an airflow induced by said subatmospheric pressure sustaining means.

6. Apparatus as defined in claim 5 wherein said cover is supported by hinge means which is generally aligned in a plane passing through said labyrinth seal between said outer ring and said cover.

7. Apparatus as defined in claim 1 wherein the end portion of said blade support posts match the curvature of said outer ring at the inner surface thereof, with each post having a longitudinal slot therein for holding a cutter blade, and with the portion of each post intermediate said inner plate and outer ring being such that the sides thereof adjacent said longitudinal slot are beveled to define an acute angle.

8. Apparatus as defined in claim 1 wherein said pressure roller has a diameter in excess of one-half the diameter of said reel.

9. Apparatus as defined in claim 1 wherein said means for guiding fibers into said reel comprises:

(a) a tow inlet housing having an upper end and a lower end and definining therebetween a converging channel, said lower end having an arcuate terminus cooperatively positioned adjacent said reel for guiding said fibers thereto, said upper end having larger dimensions than said lower end and communicating with the atmosphere; and (b) tow inlet guides positioned to direct fibers to said upper end of said tow inlet housing, said guides being positioned to separate multiple fibers until said fibers enter said tow inlet housing.

10. Apparatus as defined in claim 9 wherein said arcuate terminus of said inlet housing forms a central aperture slightly narrower than the space between said plate and said ring.

11. Apparatus as defined in claim 9 including an inner housing panel disposed about said reel and said pressure roller such that air passage through said reel is substantially limited to a path through said tow inlet housing.

12. Apparatus as defined in claim 1 wherein said outer ring has an annular lip extending outwardly therefrom and defining a conical surface which flares outwardly from the inner surface of said ring and said blade support posts, the curvature of said posts matching the curvature of the inner surface of said ring at the junction thereof, the portion of said posts adjacent said cutting blade being generally triangular in shape intermediate said disc and ring, and said posts having a slot therein for holding said cutting blade; said apparatus further comprising a semi-airtight compartment surrounding said cutter reel in conjunction with said housing means, said housing means comprising a hinged cover mounted on said semi-airtight compartment, said hinged cover cooperating with said annular lip to create a labyrinth air seal therebetween, said cover having an aperture for discharging said cut material; said fiber means for introducing uncut fiber comprising a resiliently hinged inlet housing having an upper end and a lower end forming a channel therebetween, said lower end having an arcuate terminus in close juxtaposition with said reel, and tow inlet guides directing fibers to said upper end of said inlet housing; and wherein said pressure roller has a diameter greater than one-half the diameter of said reel.

13. Apparatus as defined in claim 1 wherein said reel is driven about a horizontal axis.

14. An improved outside-in tow cutter, including drive means and housing means therefor, wherein the improvement comprises:

(a) a cutter reel having an inner plate and an outer ring holding cutter blades such that the cutting edges thereof are radially disposed outwardly equidistant from the axis of rotation of said reel, said outer ring having an inner surface diameter slightly smaller than the diameter of the cutting edges disposed about said reel, said ring forming an annular lip extending axially outward therefrom; and (b) hopper means abutting said outer ring at said annular lip such that airflow therebetween at the abutment is substantially reduced.

15. The tow cutter of claim 14 further comprising means for reducing the air pressure within said hopper means and said reel such that air currents are induced from said reel through said hopper, thereby removing cut tow from said reel, and said means for reducing the air pressure being operatively connected to said hopper means distal said reel.

16. The tow cutter of claim 15 wherein said air pressure reducing means comprises:

(a) conduit means operatively connected to said hopper means to receive cut tow and extending from said housing means to a location for discharge of said tow; and (b) fan means positioned within said conduit means to evacuate air from said conduit and said housing.

17. The tow cutter of claim 15 wherein said hopper means comprises:

(a) a cover having an opening therein of a diameter slightly larger than the maximum diameter of said annular lip such that said cover and said lip form a labyrinth type air seal substantially reducing the flow of air therebetween, said cover having a port communicating with said air pressure reducing means; and (b) hinge means for supporting said cover hingedly to said tow cutter with said hinge means being in alignment with a plane passing generally through said air seal between said cover and said outer ring.

18. The tow cutter of claim 15 further comprising a tow inlet housing having an inner end proximal said cutter reel said inner end having an arcuate terminus subtending an arc of said cutter reel, said terminus serving to guide said tow onto said reel, and said inlet housing having an outer end distal said cutter reel with said outer end communicating with the atmosphere and being larger than said inner end, said housing forming a path for said tow to said cutter reel.

19. The tow cutter of claim 18 wherein said tow inlet housing is hingedly mounted to said tow cutter and resiliently urged into an operating position with the terminus thereof proximal said cutter reel.

20. The tow cutter of claim 18 further comprising tow inlet guides positioned upstream from said two inlet housing for directing uncut tow into said tow inlet housing, said guides separating multiple tows until said tows enter said tow inlet housing.

21. The tow cutter of claim 18 wherein said terminus has a central aperture slightly narrower than the space between said ring and said plate.

22. The tow cutter of claim 14 wherein said annular lip defines a conical surface which flares outwardly from the inner surface of said outer ring and has an outer edge extending a distance from said cutter blades greater than the space between said cutter blades.

23. The tow cutter of claim 14 further comprising a plurality of angularly spaced cutter blade support posts mounted on the inner surface of said outer ring with each post having a longitudinal slot therein for receiving a cutter blade and with the sides of each blade being beveled relative to each other intermediate said inner plate and said outer ring such that said longitudinal slot is at the apex of an acute angle defined by the beveled sides of the post.

24. The tow cutter of claim 16 further comprising a pressure roller having a diameter greater than half the diameter of said cutting reel.

25. The tow cutter of claim 14 wherein the inner surface diameter of said outer ring is less than 15 mm smaller than the diameter of said cutting edges.

26. An improved outside-in tow cutter, including drive means and housing means therefor, wherein the improvement comprises:

(a) a cutter reel having an inner plate and an outter ring holding cutter blades such that the cutting edges thereof are radially disposed outwardly equidistant from the axis of rotation of said reel, said outer ring having an inner surface diameter less than 15 mm smaller than the diameter of the cutting edges disposed about said reel, said ring forming an annular lip extending axially outward therefrom; and (b) said outer ring attached to said inner plate by a plurality of support posts located radially inward of said ring and abutting the inner surface of said ring.

* * * * *